US007815191B2

(12) United States Patent
Fanning

(10) Patent No.: US 7,815,191 B2
(45) Date of Patent: Oct. 19, 2010

(54) EQUALS: THE GAME OF STRATEGY FOR THE BASIC FACTS

(75) Inventor: Mary Kay Bacallao Fanning, Fayetteville, GA (US)

(73) Assignee: Mary Kay Bacallao, Fayetteville, GA (US)

( * ) Notice: Subject to any disclaimer, the term of this patent is extended or adjusted under 35 U.S.C. 154(b) by 0 days.

(21) Appl. No.: 12/287,488

(22) Filed: Oct. 10, 2008

(65) Prior Publication Data

US 2009/0115131 A1 May 7, 2009

Related U.S. Application Data

(60) Provisional application No. 61/001,259, filed on Nov. 1, 2007.

(51) Int. Cl.
*A63F 3/00* (2006.01)

(52) U.S. Cl. ..... 273/236; 273/287; 434/203

(58) Field of Classification Search ..... 273/236, 273/284, 287; 434/203, 204, 205, 206; D21/2, D21/6

See application file for complete search history.

(56) References Cited

U.S. PATENT DOCUMENTS

| | | | | | |
|---|---|---|---|---|---|
| 271,749 | A * | 2/1883 | Stewart | 434/192 |
| 487,695 | A * | 12/1892 | Collins | 434/203 |
| D83,276 | S * | 2/1931 | Pavelka | D21/784 |
| 2,471,762 | A * | 5/1949 | Merrett | 446/227 |
| 4,233,757 | A * | 11/1980 | Narcise | 434/203 |
| 4,743,029 | A * | 5/1988 | Consolatore et al. | 273/243 |
| 6,676,415 | B2 * | 1/2004 | Walker et al. | 434/203 |
| D513,762 | S * | 1/2006 | Young | D18/6 |

* cited by examiner

*Primary Examiner*—Vishu K. Mendiratta

(57) ABSTRACT

An open rectangular prism with rotating cubes on dowel rods, two 12-sided dice, and three 20-sided dice invented with an accompanying method of use to function as a game to assist students in remembering the basic math facts including addition, subtraction, multiplication, and division.

1 Claim, 6 Drawing Sheets

FIG. 8

| | | | | | | | | | | | | | | | | | | |
|---|---|---|---|---|---|---|---|---|---|---|---|---|---|---|---|---|---|---|
| | | | | | | | | | + | | | | | | | | | |
| 6 | 9 | 16 | 24 | 25 | 28 | 42 | 63 | 64 | ÷ | | | | | | | | | |
| 18 | 17 | 16 | 15 | 14 | 13 | 12 | 11 | 10 | - | | | | | | | | | |
| 1 | 2 | 3 | 4 | 5 | 6 | 7 | 8 | 9 | x | 1 | 2 | 3 | 4 | 5 | 6 | 7 | 8 | 9 |

| | | | | | | | | | | | | | | | | | | |
|---|---|---|---|---|---|---|---|---|---|---|---|---|---|---|---|---|---|---|
| 1 | 2 | 3 | 4 | 5 | 6 | 7 | 8 | 9 | + | 1 | 2 | 3 | 4 | 5 | 6 | 7 | 8 | 9 |
| 18 | 17 | 16 | 15 | 14 | 13 | 12 | 11 | 10 | - | | | | | | | | | |
| 8 | 12 | 18 | 36 | 45 | 54 | 56 | 72 | 81 | ÷ | | | | | | | | | |
| | | | | | | | | | x | | | | | | | | | |

EQUALS: THE GAME OF STRATEGY FOR THE BASIC FACTS

CROSS REFERENCE TO RELATED APPLICATIONS

This application claims benefit of provisional application filed on Nov. 1, 2007. Equals: A Game of Strategy for the Basic Facts No. 61/001,259.

STATEMENT REGARDING FEDERALLY SPONSORED RESEARCH OR DEVELOPMENT

NA

REFERENCE TO SEQUENCE LISTING, A TABLE, OR A COMPUTER PROGRAM LISTING COMPACT DISC APPENDIX

NA

BACKGROUND OF THE INVENTION

1. Field of the Invention

The field of the invention relates to a structure and method developed that can be used to assist elementary students in memorizing basic addition, subtraction, multiplication, and division facts.

2. Background Art

The invention was developed to utilize elementary students' innate desire to play games with friends and get them to reason and be able to recall the basic math facts in a low stress environment. The cubes on two sides of the game were designed to turn so that each of the four basic math operations including addition, subtraction, multiplication and division could be selected and used while playing the game. The 12-sided and 20-sided numbered dice were designed to enable the elementary students to roll the answers for problems involving the four basic math operations. The numbers found on the cubes were designed so that the students would be able to use basic math facts found in math computational exercises while playing the game. The method of playing the game was designed to engage students in conversation and thinking about basic facts in an effort to enhance long-term retention of the basic math facts including addition, subtraction, multiplication, and division.

BRIEF SUMMARY OF THE INVENTION

The invention consists of a rectangular box with 19 rotating cubes on each long side and 1 rotating numbered cube on each short side. It comes with two 12-sided numbered dice and three 20-sided numbered dice. Directions detail the method of playing the game so that students can reason and practice the basic math facts while competing with other students.

BRIEF DESCRIPTION OF THE SEVERAL VIEWS OF THE DRAWING

FIG. 8 is a layout of the numbers printed on the cubes on the long sides of the box.

DETAILED DESCRIPTION OF THE INVENTION

Figure 1:
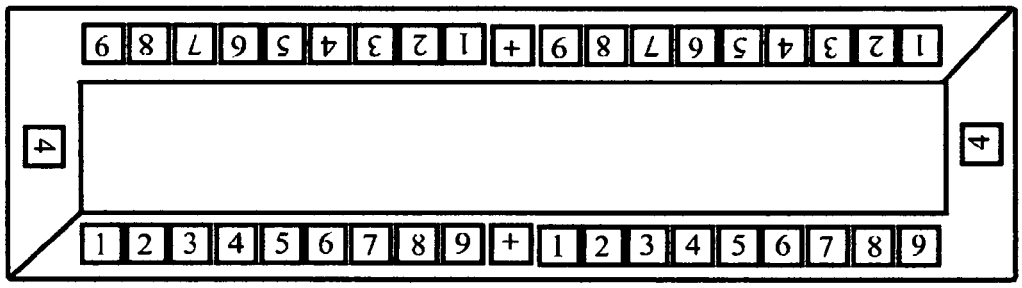
FIG. 1 depicts a view of the physical structure of the game box from above.
Figure 2:
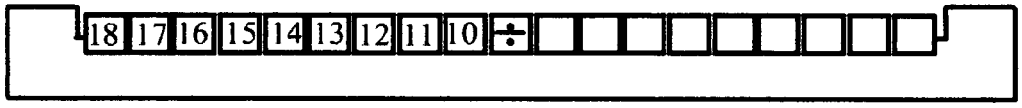
FIG. 2 depicts a view of the physical structure of the game box from the long side.
Figure 3:
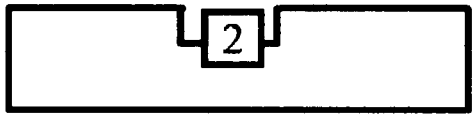
FIG. 3 depicts a view of the physical structure of the game box from the short side.
Figure 4:
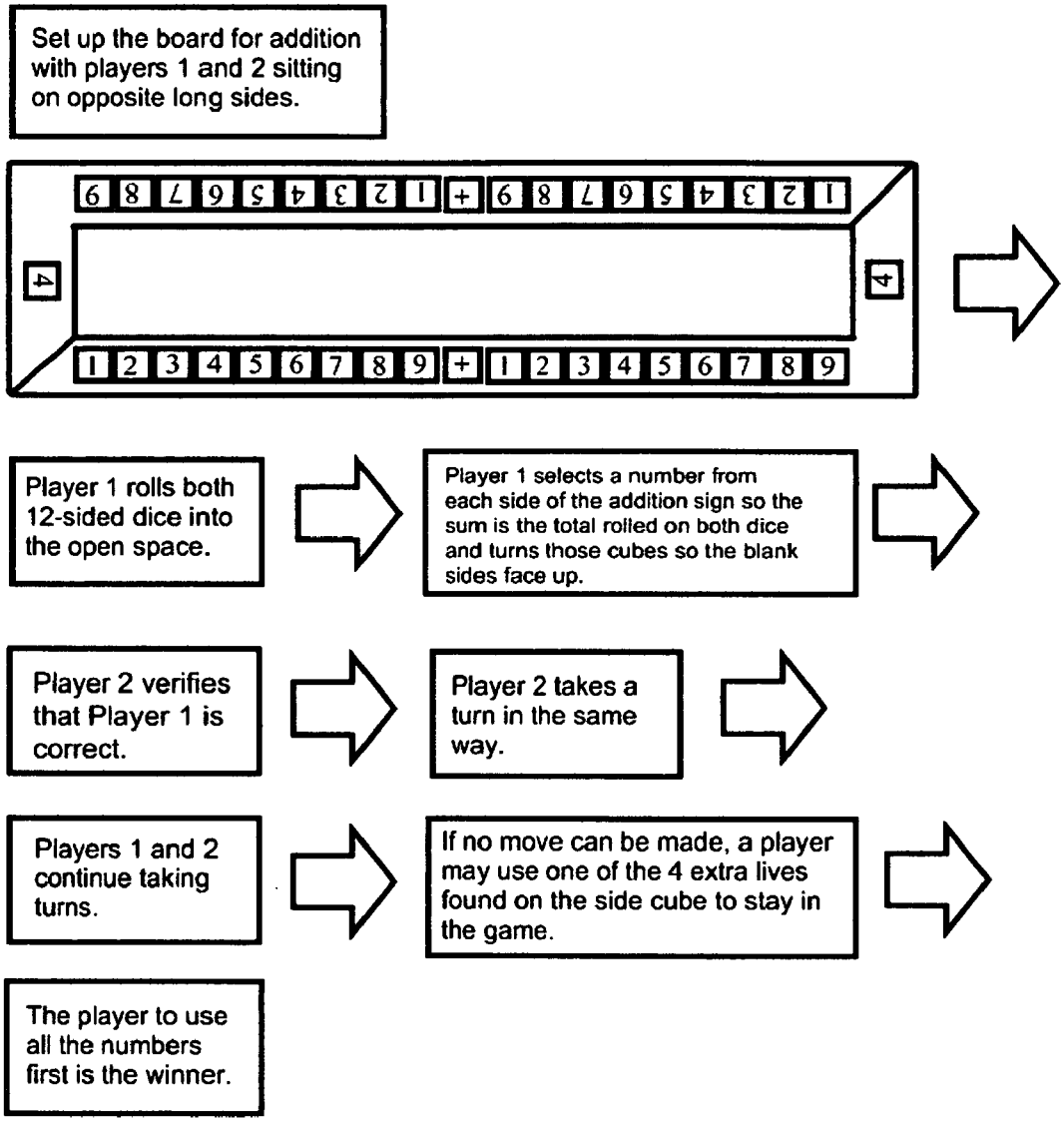
FIG. 4 is a flow chart describing the method of playing the game for addition.
Figure 5:
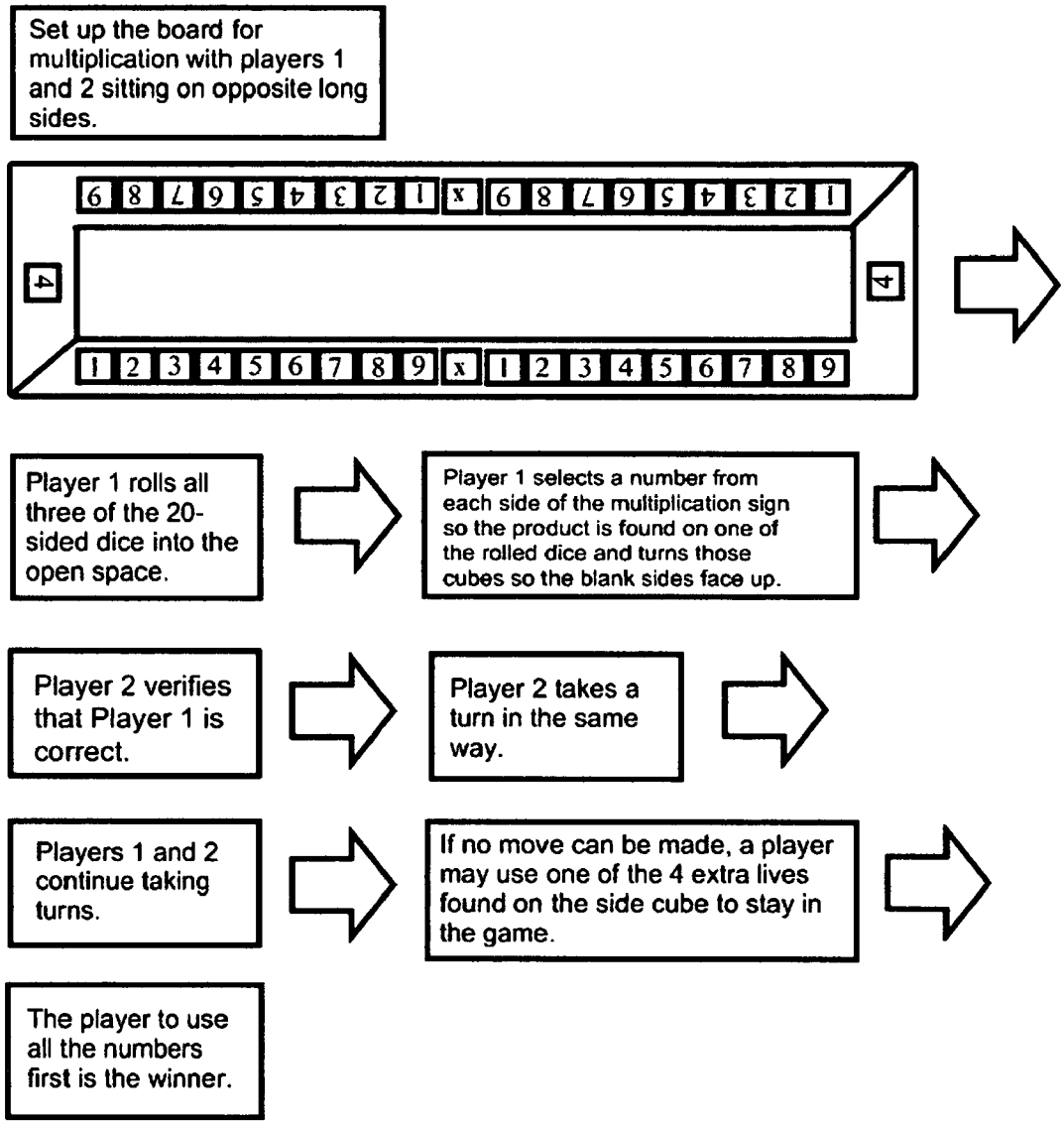
FIG. 5 is a flow chart describing the method of playing the game for multiplication.
Figure 6:
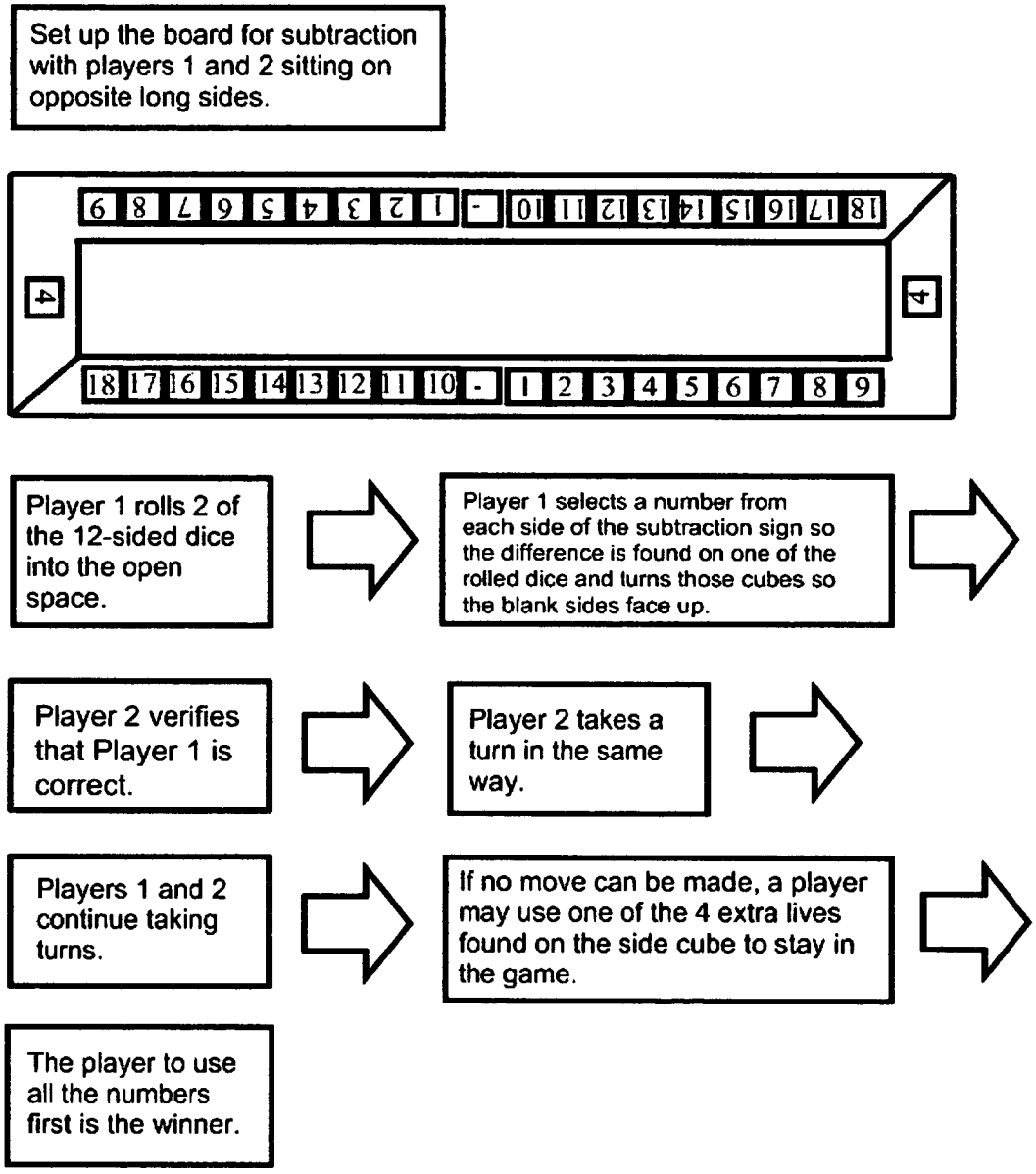
FIG. 6 is a flow chart describing the method of playing the game for subtraction.
Figure 7:
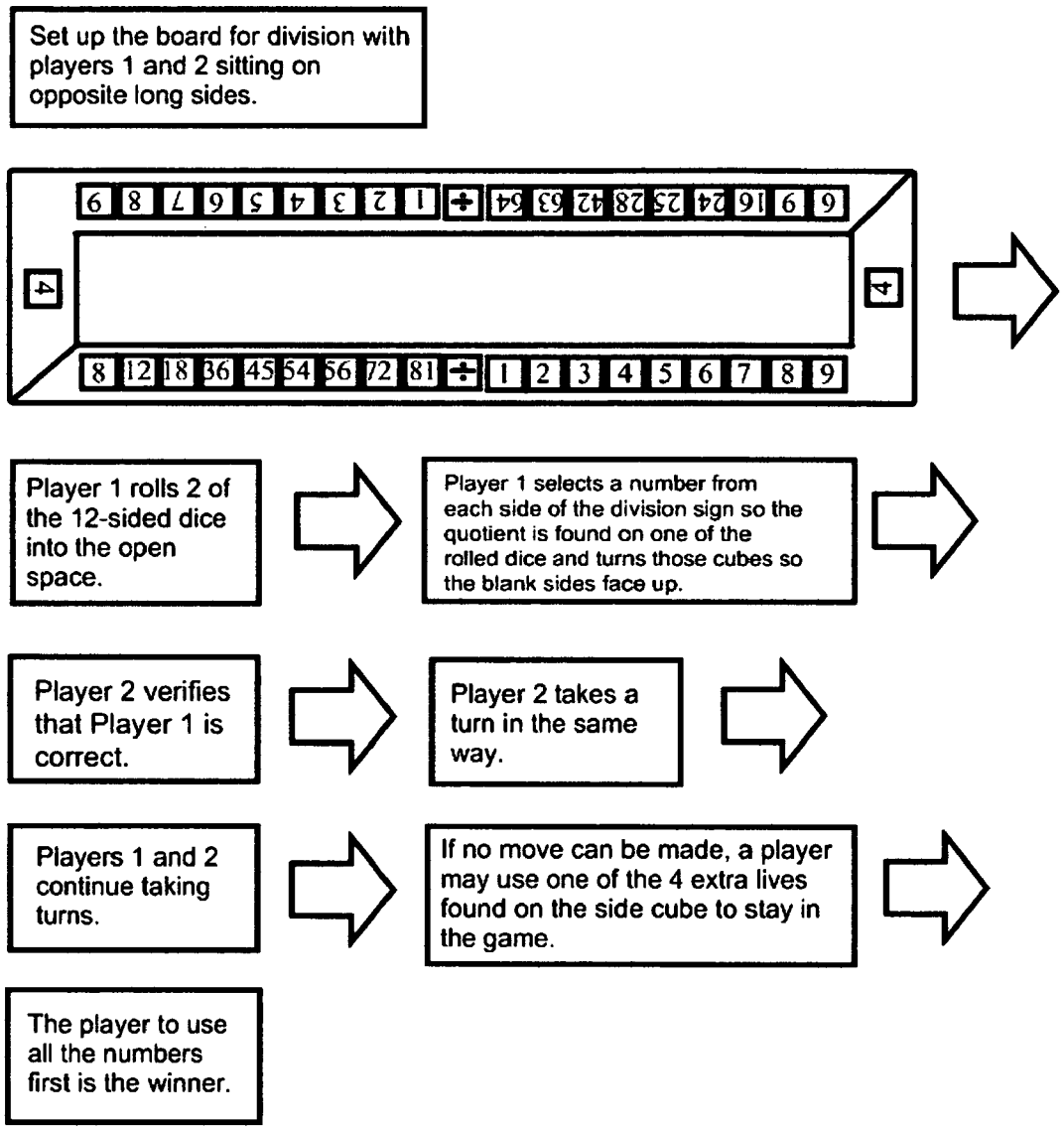
FIG. 7 is a flow chart describing the method of playing the game for division.

1. Game box:

The base of the game box is rectangular and there are 4 rectangular sides attached to the base and to the other sides (FIG. 1, FIG. 2, and FIG. 3). The cubes have holes and are attached to the top of the sides through dowel rods. Two cube sides are used for the dowel holes and the other sides have numbers or are blank in the arrangement shown in FIG. 8.

2. The cube sides:
   - A. The symbols are all yellow (+, −, ×, and ÷)
   - B. The 1-9 cube sides are all the same color.
   - C. The 18-10 cube sides are all the same color.
   - D. The 8-81 and the 6-64 cube sides are all the same color.
   - E. The blank cubes are all the same color.
3. The box interior and exterior:
   - A. One long and one short side of the game box are blue and represent "day."
   - B. One long and one short side are dark blue and represent "night".
4. Side cube side design:

The single cubes on the remaining sides of the box will have these numbers on them: 1, 2, 3, and 4. The cubes will face in an outward direction (FIG. 3)
5. The dice: The 12-sided dice are a different color from the 20-sided dice. The numbers are clear so that there is a way to understand the difference between the numbers on the dice. Dice 1 and 2 are dodecahedrons. Dice 3, 4, and 5 are icosahedrons.
   - A. Dice 1 printed numbers: 1, 2, 3, 4, 5, 6, 7, 8, 9, 3, 5, & 7
   - B. Dice2 printed numbers: 1, 2, 3, 4, 5, 6, 7, 8, 9, 4, 6, & 8
   - C. Dice3 printed numbers: 4, 5, 7, 10, 12, 15, 16, 18, 20, 21, 24, 28, 35, 36, 42, 49, 54, 56, 64, & 72
   - D. Dice 4 printed numbers: 1, 2, 3, 6, 8, 9, 12, 14, 18, 24, 25, 27, 30, 32, 36, 40, 45, 48, 63 & 81
   - E. Dice 5 printed numbers: 4, 6, 8, 9, 12, 16, 21, 25, 27, 28, 32, 35, 36, 42, 48, 49, 54, 56, 64, & 72
6. Function: The cubes are on dowel rods and can be rotated. They will stay in place when not in use.
7. Methods of playing the game for 2 players:

A. Addition:

To set up the board: Have each player choose a side. Each side has 2 sets of numbers with a sign in the middle. Choose the addition symbol in the middle of the sets of numbers so that it faces up. Choose the numbers 1-9 on both sides of the addition symbol so that they face up.

To play: Roll dice 1 and 2 at the same time. (These dice have 12 sides). Add what you roll on both dice. This is the total number you are looking for. Then find 2 numbers on either side of the addition symbol that will add up to equal that total. Turn the cubes so the blank square is showing instead of the number. The aim is to eliminate all the numbers so that only the blank sides of the cubes remain. If you have no move to make, you may use the numbers on the side as an extra life and stay in the game for your next turn. This game may also be played with only one player trying to beat the game.

B. Subtraction:

To set up the board: Have each player choose a side. Each side has 2 sets of numbers with a symbol in the middle. Choose the subtraction symbol in the middle of the sets of numbers so that it faces up. Choose the numbers 18-10 on the left side of the subtraction symbol and the numbers 1-9 on the right side of the subtraction symbol so that they face up.

To play: Roll dice 1 and 2 at the same time. (These dice have 12 sides). Select one of the numbers rolled to be the difference between two numbers on the cubes. Then find a number on the left side of the subtraction symbol and subtract a number on the right side of the subtraction symbol from it. The answer should be the number rolled. Turn the cubes that were selected so the blank square is showing instead of the number. The aim is to eliminate all the numbers so that only the blank sides of the cubes remain. If you have no move to make, you may use the numbers on the side as an extra life and stay in the game for your next turn. This game may also be played with only one player trying to beat the game.

C. Multiplication:

To set up the board: Have each player choose a side. Each side has 2 sets of numbers with a symbol in the middle. Choose the multiplication symbol in the middle of the sets of numbers so that it faces up. Choose the numbers 1-9 on both sides of the multiplication symbol so that they face up.

To play: Roll dice 3, 4, and 5 at the same time. (These dice have 20 sides). Select one of the numbers rolled to be the product of two numbers on opposite sides of the multiplication symbol. Choose a number on each side of the multiplication symbol that when multiplied will equal one of the numbers rolled. Turn the selected cubes so the blank square is showing instead of the number. The aim is to eliminate all the numbers so that only the blank sides of the cubes remain. If you have no move to make, you may use the numbers on the side as an extra life and stay in the game for your next turn. This game may also be played with only one player trying to beat the game.

D. Division:

To set up the board: Have each player choose a side. Each side has 2 sets of numbers with a symbol in the middle. Choose the division symbol in the middle of the sets of numbers so that it faces up. Choose the numbers 8-81 or 6-64 on the left side of the division symbol so that they face up. Choose the numbers 1-9 on the right side of the division symbol so they face up.

To play: Roll dice 1 and 2. (These dice have 12 sides). Select one of the numbers rolled or a combination of the numbers rolled to be the dividend. Choose a number on each side of the division symbol that when divided will equal one of the numbers rolled or a combination of the numbers rolled. Turn the selected cubes so the blank square is showing instead of the number. The aim is to eliminate all the numbers so that only the blank sides of the cubes remain. If you have no move to make, you may use the numbers on the side as an extra life and stay in the game for your next turn. This game may also be played with only one player trying to beat the game.

8. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mathematical game apparatus comprising:

(a) a rectangular box having a base, four walls attached to the base and adjoining walls configured to have a storage space, and said walls displaying open top edges;

(b) the rectangular box further having colored opposite sides selected from a plurality of colors;

(c) each top edge having an open rectangular shaped groove;

(d) a dowel rod mounted within each groove supported at each end of the rod;

(e) each of two smaller dowel rods mounted on smaller sides of the rectangular box having one cube, each cube with a hole through two opposite faces, each cube freely suspended and rotatable on the dowel rod to display other four faces;

(f) four visible faces on each cube on smaller rods displaying numerals 1, 2, 3, and 4 in a numerical order;

(g) each of two longer dowel rods mounted on longer sides of the rectangular box having nineteen cubes, each cube with a hole through two opposite faces, each cube freely suspended and rotatable on the dowel rod to display other four faces;

(h) four visible faces on each of nineteen cubes on longer rods displaying a combination selected from a numeral, a mathematical symbol, and blank colored faces;

markings on the cubes on the first side of the rotating cubes 1, 2, 3, 4, 5, 6, 7, 8, 9, +, 1, 2, 3, 4, 5, 6, 7, 8, 9; with markings on the second side of the rotating cubes 18, 17, 16, 15, 14, 13, 12, 11, 10, −, remaining cubes blank; markings on the third side of the rotating cubes on one side of the game board 8, 12, 18, 36, 45, 54, 56, 72, 81, ÷, remaining cubes blank; markings on the third side of the rotating cubes and on the opposite side of the game board 6, 9, 16, 24, 25, 28, 42, 63, 64, ÷, remaining cubes blank; markings on the fourth side of the rotating cubes blank except for the middle cubes on both sides with the symbol X;

(i) two 12 sided dice and three 20 sided dice storable in the storage space of the box; markings on the first of the 12-sided dice 1, 2, 3, 4, 5, 6, 7, 8, 9, 3, 5, 7; markings on the second of the 12-sided dice 1, 2, 3, 4, 5, 6, 7, 8, 9, 4, 6, 8; markings on the first of the 20-sided dice 4, 5, 7, 10, 12, 15, 16, 18, 20, 21, 24, 28, 35, 36, 42, 49, 54, 56, 64, 72; markings on the second of the 20-sided dice 1, 2, 3, 6, 8, 9, 12, 14, 18, 24, 25, 27, 30, 32, 36, 40, 45, 48, 63, 81; markings on the third of the 20-sided dice 4, 6, 8, 9, 12, 16, 21, 25, 27, 28, 32, 35, 36, 42, 48, 49, 54, 56, 64, 72.

* * * * *